US006260936B1

(12) United States Patent
Frank et al.

(10) Patent No.: US 6,260,936 B1
(45) Date of Patent: Jul. 17, 2001

(54) OPERATOR INTERFACE FOR MOBILE CARRIAGE

(75) Inventors: Jeffrey W. Frank; Steven Krug, both of Mayville, WI (US)

(73) Assignee: Tab Products Company, Inc., Vernon Hills, IL (US)

( * ) Notice: Subject to any disclaimer, the term of this patent is extended or adjusted under 35 U.S.C. 154(b) by 0 days.

(21) Appl. No.: 09/415,071

(22) Filed: Oct. 12, 1999

(51) Int. Cl.[7] ..... H01H 13/70
(52) U.S. Cl. ..... 312/201; 200/343
(58) Field of Search ..... 312/198, 201, 312/199; 200/343

(56) References Cited

U.S. PATENT DOCUMENTS

| | | | | |
|---|---|---|---|---|
| D. 331,388 | | 12/1992 | Dahnert et al. . | |
| 4,032,729 | * | 6/1977 | Koistinen | 200/343 X |
| 4,119,376 | | 10/1978 | Moyer . | |
| 4,412,772 | * | 11/1983 | Naito et al. | 312/201 X |
| 4,559,427 | * | 12/1985 | Dolson et al. | 200/343 X |
| 4,582,967 | * | 4/1986 | Brumit et al. | 200/343 X |
| 4,703,160 | | 10/1987 | Narishima et al. . | |
| 4,733,523 | | 3/1988 | Dahnert . | |
| 5,050,941 | * | 9/1991 | Dahnert et al. | 312/201 |
| 5,636,750 | * | 6/1997 | Heyl | 312/201 X |
| 6,027,267 | * | 2/2000 | Yokobori | 200/343 X |

FOREIGN PATENT DOCUMENTS

| | | | | |
|---|---|---|---|---|
| 2933150 | * | 2/1981 | (DE) | 200/344 |

* cited by examiner

*Primary Examiner*—Janet M. Wilkens
(74) *Attorney, Agent, or Firm*—Donald Cayen

(57) ABSTRACT

An attractive single-piece operator interface for high density mobile storage conveys an intuitive meaning to operators. The operator interface includes a bezel mounted to the outside of a mobile carriage panel. Self-leveling buttons are pivotally connected by living hinges to openings in the bezel. The buttons are in operative association with respective switches in a control assembly on the inside of the mobile carriage panel. A base on the control assembly limits pivoting of the buttons. The operator interface is made of ABS plastic material. The buttons are preferably shaped to indicate the directions of mobile carriage travel. The bezel further includes holes that receive light emitting diodes that are part of the control assembly.

37 Claims, 5 Drawing Sheets

OPERATOR INTERFACE FOR MOBILE CARRIAGE

BACKGROUND OF THE INVENTION

1. Field of the Invention

This invention pertains to high density mobile storage, and more particularly to apparatus that controls the movement of mobile carriages.

2. Description of the Prior Art

Electrically powered mobile carriages for high density mobile storage are well developed. The mobile carriages are operated by a control system to move individually or as a group, depending on the location of a carriage and the particular aisle access required by the operator.

The control system typically includes a small operator housing containing manual switches and buttons. The operator housing is normally on an end panel of the carriage, where it is easily accessible to the operator. Typical control systems are generally shown in U.S. Pat. Nos. 4,119,376, 4,733,923, 4,743,078, 5,160,190, and 5,569,910. U.S. Pat. No. 5,050,941 and U.S. Pat. No. Des. 331,388 show a mobile carriage switch assembly and control panel in some detail.

Prior mobile carriage control systems also included a module of electronic components on each carriage. The control modules were connected by electrical cables to the operator housings. The control modules typically receive line power and convert it to power suitable for driving the carriage motors. The modules also pass the line power to adjacent carriages.

The manual buttons and switches of prior mobile carriage control systems were strictly utilitarian. That is, the various switches and buttons performed their respective functions adequately but without regard for aesthetic considerations. Moreover, the prior buttons and switches gave minimal attention to any intuitive considerations of an operator as he made his decisions when operating the mobile carriages. In addition, the prior design of separate operator housings and electronic modules connected by a cable was undesirably expensive.

To enhance the appearance and ergonomics of high density mobile storage, a new interface between the mobile carriages and the operators was proposed. The new interface was to include a cluster of operating buttons incorporated into the interior of a frame. In keeping with the purpose of the buttons, they were to be made relatively long compared with their width, and they were to be shaped and located to conform to the intuition of an operator. Further, acrylonitrile butadiene styrene (ABS) copolymer plastic was the preferred material, because very attractive parts could be made from that material.

However, two problems arose in trying to design the combined button-frame interface. The first problem was that a relatively long and narrow button requires some kind of a leveling mechanism so that it does not cock and bind in the frame when the button is depressed. One solution was to use thin wires retained in the frame and in the undersides of the buttons. However, the molds required for the proposed new mobile carriage interface with leveling wires between the frame and the buttons were prohibitively expensive for the relatively small volume of parts used with high density mobile storage. It was therefore necessary to find a way to self-level the buttons through a direct connection between the buttons and the frame. That necessity dictated that hinged connections be used between the buttons and the frame.

A hinged design raised the second problem, which is that ABS plastic material is generally unsuitable for parts that must flex during operation. If the hinge connection is relatively long and straight, ABS can work. For example, U.S. Pat. Nos. 4,375,585, 4,703,160, 4,786,892, 5,184,283; and 5,828,364 show various devices in which straight living hinges of ABS material extend for the full length of the parts hinged together. In the proposed mobile carriage interface, however, aesthetic considerations dictate that only curved sides be used on all the buttons.

Thus, a number of problems required solution to achieve a successful mobile carriage interface design.

SUMMARY OF THE INVENTION

In accordance with the present invention, a single-piece operator interface made of ABS material is provided that combines pleasing aesthetics with superior functionality. This is accomplished by apparatus that includes buttons shaped and arranged within and connected to a bezel in a manner that renders the button functions intuitive.

According to one aspect of the invention, the interface buttons are designed with peripheral walls that are all curved. They fit within respective matching curved openings in the bezel. The central portion of the bezel is preferably concave, and the buttons are located in the concave portion. Each button is connected on its periphery to the bezel by a living hinge. To enable the living hinges connecting to curved surfaces to operate, each hinge is relatively narrow. To improve the fatigue strength in bending of the living hinges, they are fabricated with grooves along their transverse axes.

There is a switch behind each button. Preferably, the contact area of the button on the switch is along the longitudinal axis of the button living hinge. Manually pressing a button causes it to pivot about the living hinge transverse axis and actuate the corresponding switch.

It is a feature of the invention that the interface buttons may be considerably longer than they are wide. Consequently, it is conceivable, and even desirable, that an operator's finger press on a button at a point that is relatively far from the living hinge longitudinal axis. To minimize the distance from the finger contact point to the living hinge longitudinal axis, the hinge is located approximately at a midpoint between the button ends.

As mentioned, the switch associated with each button is preferably located on the longitudinal axis of the button living hinge. The switches require a small but measurable amount of force to actuate. Because of the length of a button, it tends to rotate about the hinge longitudinal axis, as well as pivot about the transverse axis, when it is pressed near an end. To prevent the possibility that the button would not pivot about the transverse axis sufficiently when pressed at an end to actuate the switch, the living hinge is designed with substantial torsional rigidity about its longitudinal axis. Consequently, the button motion is primarily pivoting about the living hinge transverse axis when the button is pressed, regardless of where an operator places his finger. In practice, therefore, the button is self-leveling.

When applied to a mobile carriage of high density mobile storage, the operator interface possesses further desireable features. Specifically, two of the buttons are designed to intuitively indicate the opposite directions that a mobile carriage moves. An operator is thus inclined to press the button that corresponds with the desired direction of mobile carriage movement without exercising much conscious thought.

According to another aspect of the invention as applied to high density mobile storage, the operator interface is an integral part of the mobile carriage control assembly, thereby eliminating the cable connections of prior mobile carriage control systems. In the preferred embodiment, the control assembly includes the switches that are actuated by the operator interface. The control assembly is fastened to the inside surface of an end panel of the mobile carriage. There is an opening in the end panel to accommodate the switches. The operator interface bezel is mounted to the outside surface of the end panel such that the buttons are aligned with the associated switches of the control assembly. The control assembly also provides a mechanical stop that limits the pivoting of the buttons. That feature contributes to long fatigue life for the living hinges. The result is a very reliable and attractive control system for the mobile carriages.

The method and apparatus of the invention, using short living hinges between curved buttons and a bezel, thus provides a one-piece operator interface for mobile carriages. The living hinges have adequate fatigue strength, and the buttons are self-leveling, even though the interface is made of ABS plastic and employs no separate leveling parts.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
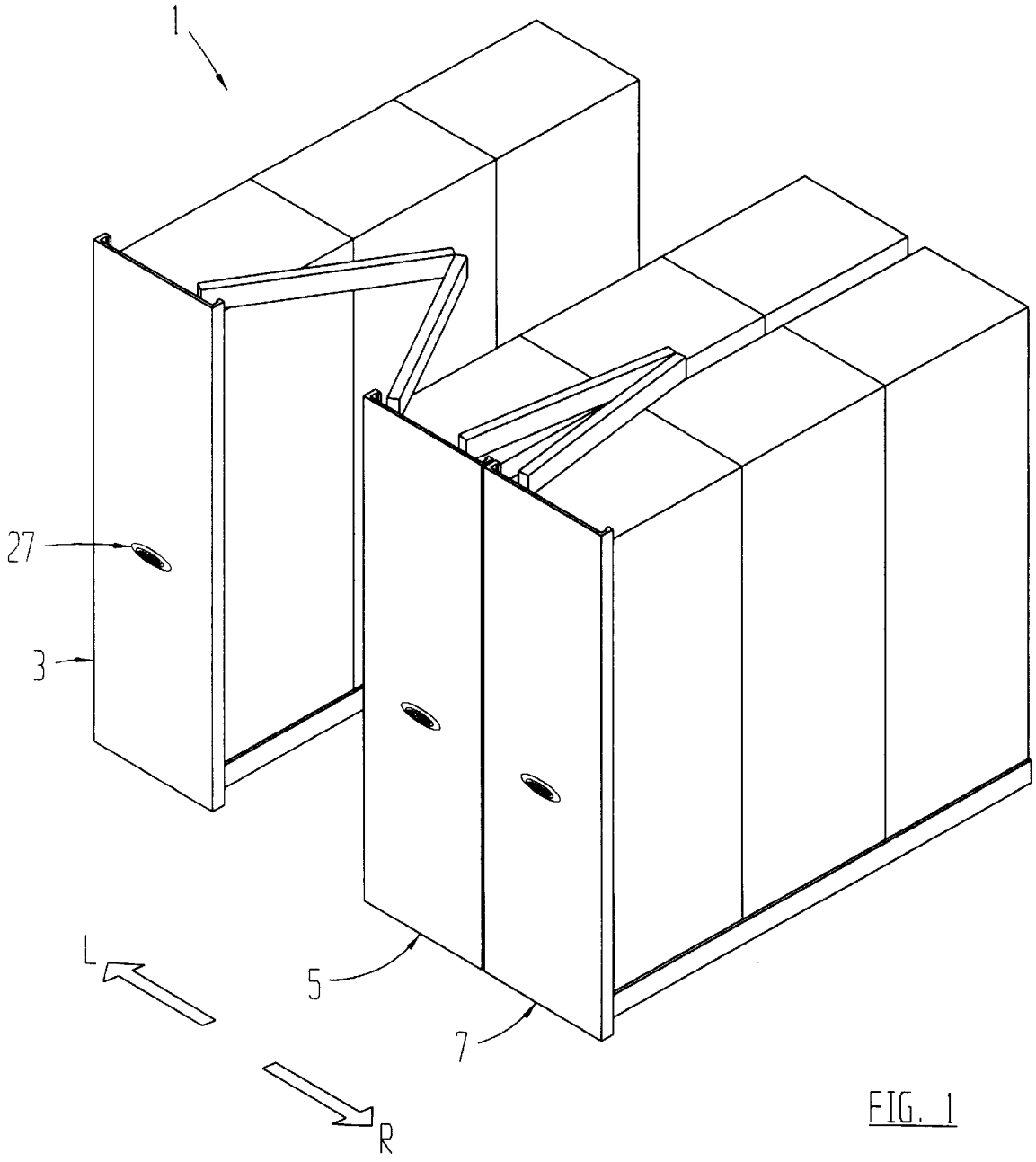
FIG. 1 is a perspective view of typical high density mobile storage that includes the operator interface of the present invention.

Referring to FIG. 1, typical high density mobile storage 1 is illustrated that includes the present invention. The high density mobile storage 1 is comprised of three substantially identical mobile carriages 3, 5, and 7. Although not shown, persons skilled in the art will understand that the mobile carriages 3, 5, and 7 include wheels that enable the carriages to roll along tracks in the directions of arrows L and R. The wheels are powered by an electric motor in each mobile carriage. Persons skilled in the art will also understand that more or fewer than three mobile carriages can be used in a high density mobile storage installation, and further that the mobile storage may include one or more stationary end cabinets.

Figure 2:
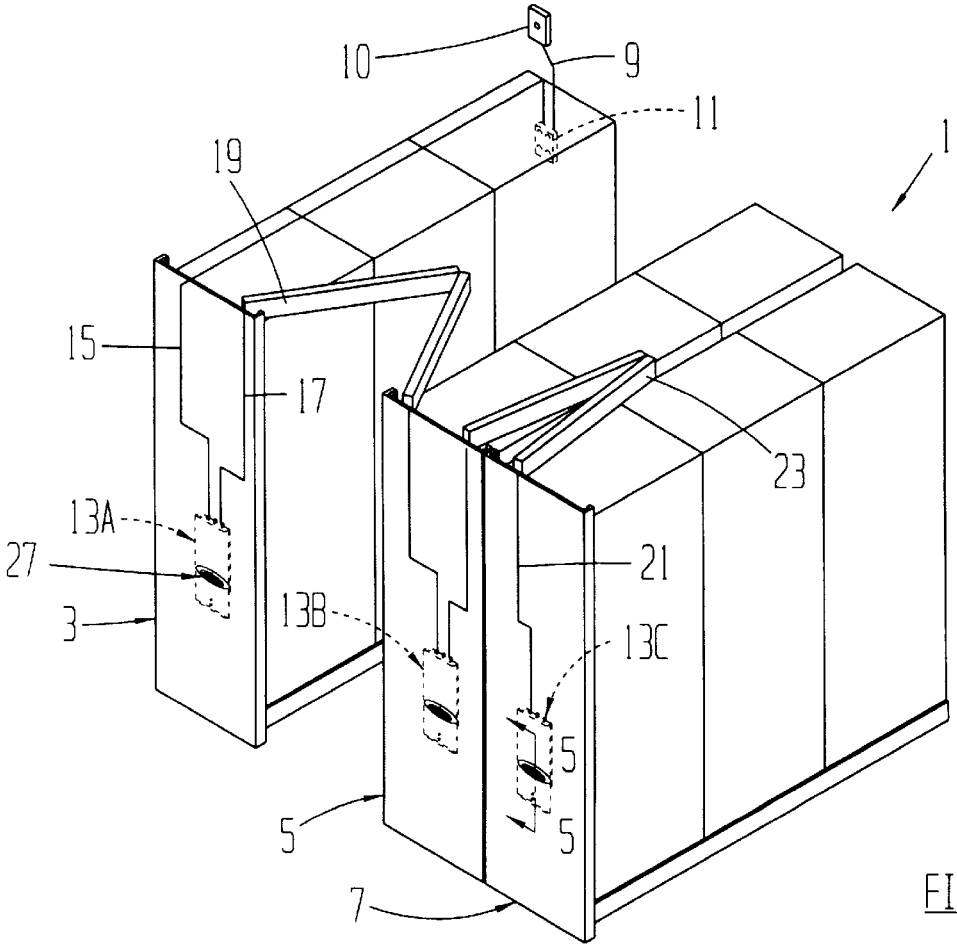
FIG. 2 is a diagrammatic view somewhat similar to FIG. 1, but showing the routing of electric power to the high density mobile storage.

FIG. 2 depicts typical power routing for the high density mobile storage 1. Line power enters the mobile carriage 3 by means of a coil cord 9 having one end at a junction box 10 on the building wall adjacent that carriage. The second end of the coil cord 9 terminates at a junction box 11 on the mobile carriage 3. The line power connects to a control assembly 13A on the mobile carriage 3 via a first power wire 15 from the junction box 11. A wire 17 brings the line power through a hinged raceway 19 to the control assembly 13B on the mobile carriage 5. A similar wire 21 and raceway 23 bring line power to the control assembly 13C of the mobile carriage 7.

In accordance with the present invention, each mobile carriage 3, 5, and 7 has an attractive and intuitive operator interface 27 by which persons control the movement of the carriages. Turning to FIGS. 3–6, the operator interface is of single-piece construction. It is preferably molded from ABS plastic material. That material is available in a wide variety of attractive colors. Further, the ABS material can be molded to give aesthetically pleasing combinations of textured and smooth surfaces.

In the preferred embodiment, the operator interface 27 comprises a bezel 29 having an oval periphery 31. The length of the bezel 29 is preferably longer than its height. The bezel has a wall 32 with a periphery 31 that terminates in a back mounting surface 33. The bezel wall 32 curves upwardly at reference numeral 34 from the mounting surface 33, and then dishes concavely toward the bezel center portion 37. On the back side of the bezel wall 32 are a pair of lugs 38.

Figure 5:
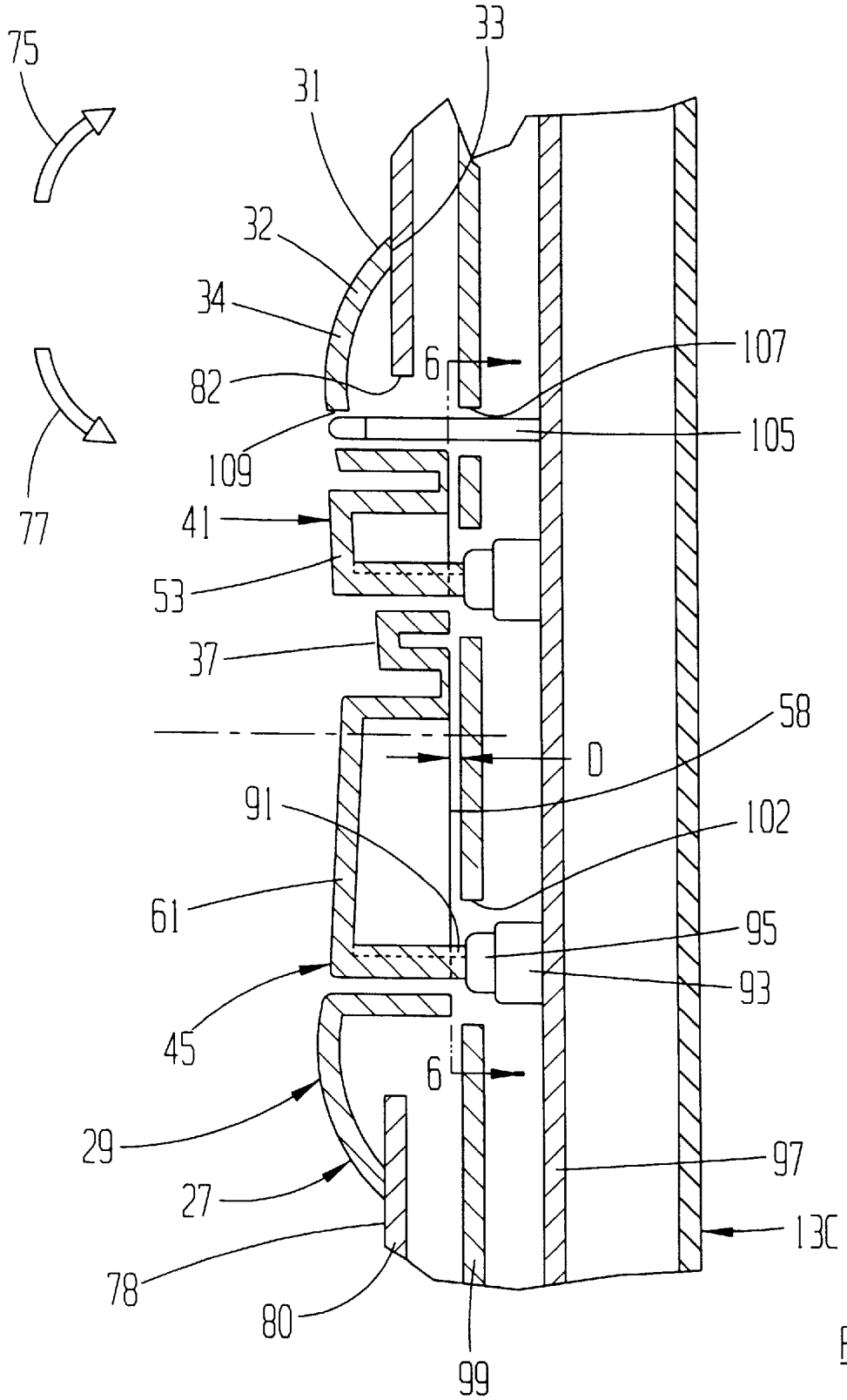
FIG. 5 is a cross-sectional view on an enlarged scale taken along line 5—5 of FIG. 2.

In the particular construction illustrated, the bezel 29 is symmetrical about a vertical centerline 40. The bezel thus has a left side 42 and a right side 44. There are four buttons 39, 41, 43, 45 incorporated into the bezel. Each button is hollow and is comprised of a peripheral wall and a top wall. Specifically, the button 39 has a peripheral wall 47 and a top wall 49; the button 41 has a peripheral wall 51 and a top wall 53; the button 43 has a peripheral wall 55 and a top wall 57; and the button 45 has a peripheral wall 59 and a top wall 61. In keeping with the aesthetic purpose of the operator interface 27, the peripheral walls 47, 51, 55, and 59 of all the buttons are made exclusively as curved walls. The peripheral walls terminate in respective bottom surfaces that lie in a common plane 58. The plane 58 of the button bottom surfaces lies beyond the bezel mounting surface 33. The buttons are received in respective openings through the bezel wall 32. Preferably, there is a gap of approximately 0.06 inches between the button peripheral walls and the associated bezel openings. As best shown in FIG. 5, the top walls of the buttons, such as the top walls 53 and 61 of the buttons 41 and 45, respectively, are located above the bezel wall 32 at the bezel concave center portion 37.

Each button 39, 41, 43, 45 is connected to the bezel wall 32 by a respective living hinge 60, 62, 63, 65. By means of the living hinges 60, 62, 63, 65, the buttons pivot about respective transverse axes 67, 69, 71, 73. The buttons are thus pivotable in the directions of arrows 75 and 77. Each of the living hinges defines a longitudinal axis 79, 81, 83, 85. The illustrated operator interface 27, as mentioned, is symmetrical about the vertical centerline 40. As illustrated, the longitudinal axes 81 and 85 of the buttons 41 and 45, respectively, are coincident with the vertical centerline 40.

Figure 7:
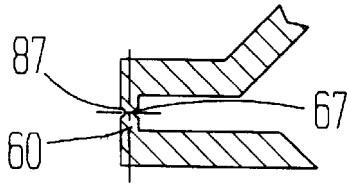
FIG. 7 is a cross-sectional view on an enlarged scale taken along line 7—7 of FIG. 4.

The design of the living hinges 60, 62, 63, 65 is important to the proper operation of the operator interface 27. Because of the curved peripheral walls 47, 51, 55, 59 of the buttons, the living hinges must be relatively short in the directions along the transverse axes 67, 69, 71, 73. On the other hand, it is important that the buttons have minimal rotational ability about the longitudinal axes 79, 81, 83, 85, as will be explained shortly. That is, the living hinges must provide adequate torsional rigidity about their longitudinal axes. In addition, the properties of the ABS material must be considered. ABS has relatively poor fatigue strength. It is therefore important that the living hinges be designed to take that characteristic into account. As a preferred way to solve the ABS fatigue strength problem, each living hinge is grooved on its opposite surfaces along the transverse axis. FIG. 7 shows hinge 60, which is typical of the other hinges. The hinge 60 has grooves 87 in each of its opposite surfaces. The grooves are preferably symmetrical about the hinge transverse axis 67. The combination of the short hinge length and the grooves 87 provide the hinges with adequate fatigue strength.

Because of the torsional rigidity of the living hinges 60, 62, 63, 65 about their respective longitudinal axes 79, 81, 83, 85, the buttons will pivot about the living hinge transverse axes regardless of the points on the buttons that the operator presses. For example, an operator can press his finger at point P on the button 39, and the button will pivot satisfactorily about the hinge transverse axis 67 with only minimal rotation about the longitudinal axis 79. In that manner, the buttons are self-leveling without requiring any separate leveling components.

Figure 4:
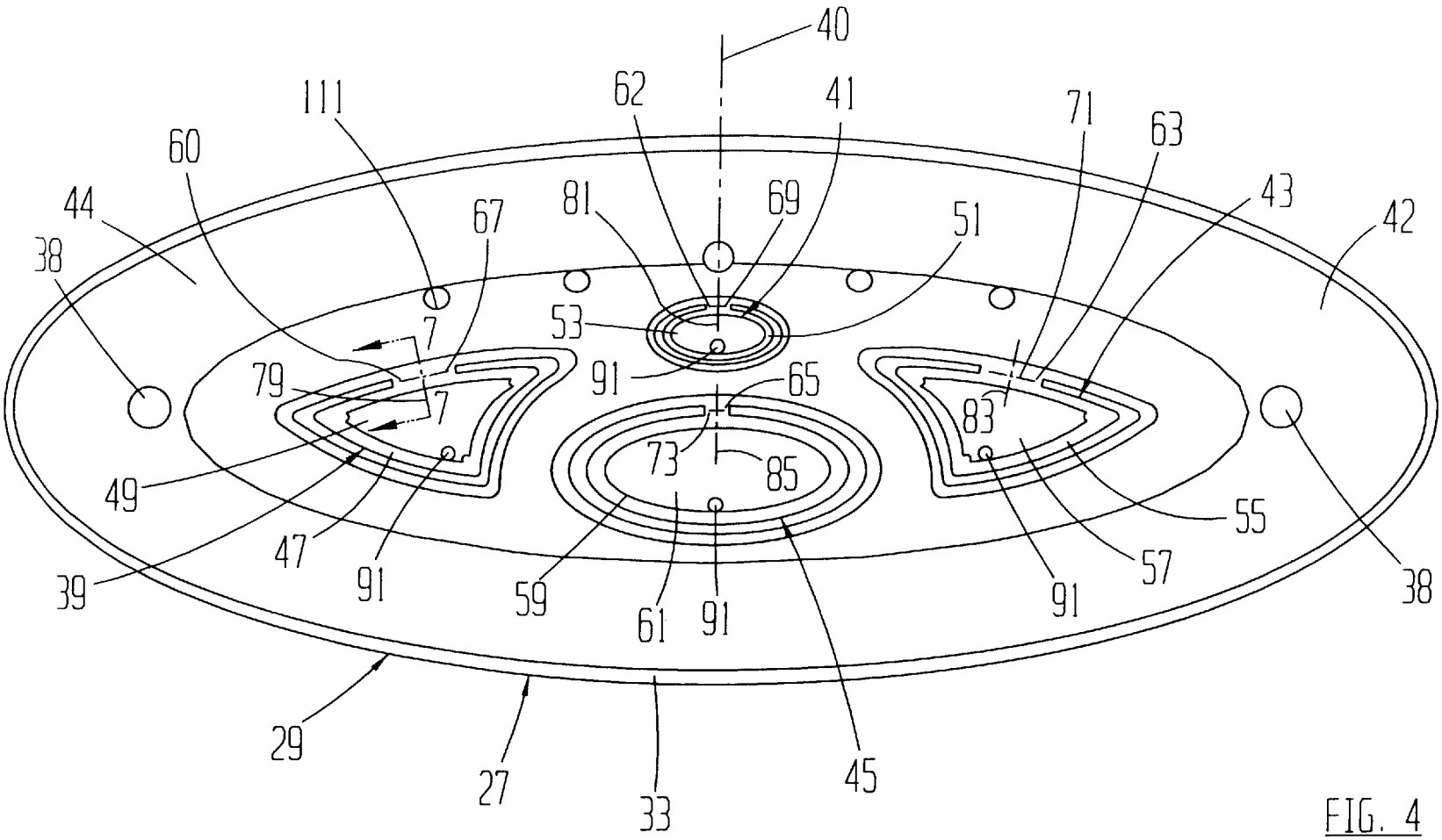
FIG. 4 is a back view on an enlarged scale of FIG. 3.

It will be noticed in FIGS. 4 and 5 that each of the buttons 39, 41, 43, 45 has a small boss 91 adjacent the respective peripheral walls 47, 51, 55, 59. Each of the bosses 91 lies on the longitudinal axis 79, 81, 83, 85 of the respective living hinge 60, 62, 63, 65. Each boss protrudes a short distance beyond the common plane 58 of the button bottom surfaces.

To control the high density mobile storage system 1 by means of the operator interfaces 27, each button 39, 41, 43, 45 is operatively associated with a respective electrical switch. In the illustrated construction, the button bosses 91 contact the actuators 95 of low profile switches 93. In turn, the switches 93 are part of a printed circuit board 97. The printed circuit board 97 also contains other electronic components that are known to persons skilled in the art for controlling mobile carriages. For example, the line power routing through the wires 15, 17, 21 (FIG. 2) goes through the printed circuit boards. Because line power is present at the printed circuit board 97, it is spaced by standoffs, not shown, from a base 99 that is part of an associated control assembly. The particular operator interface 27 illustrated in FIG. 5 shows the control assembly 13C.

Figure 8:
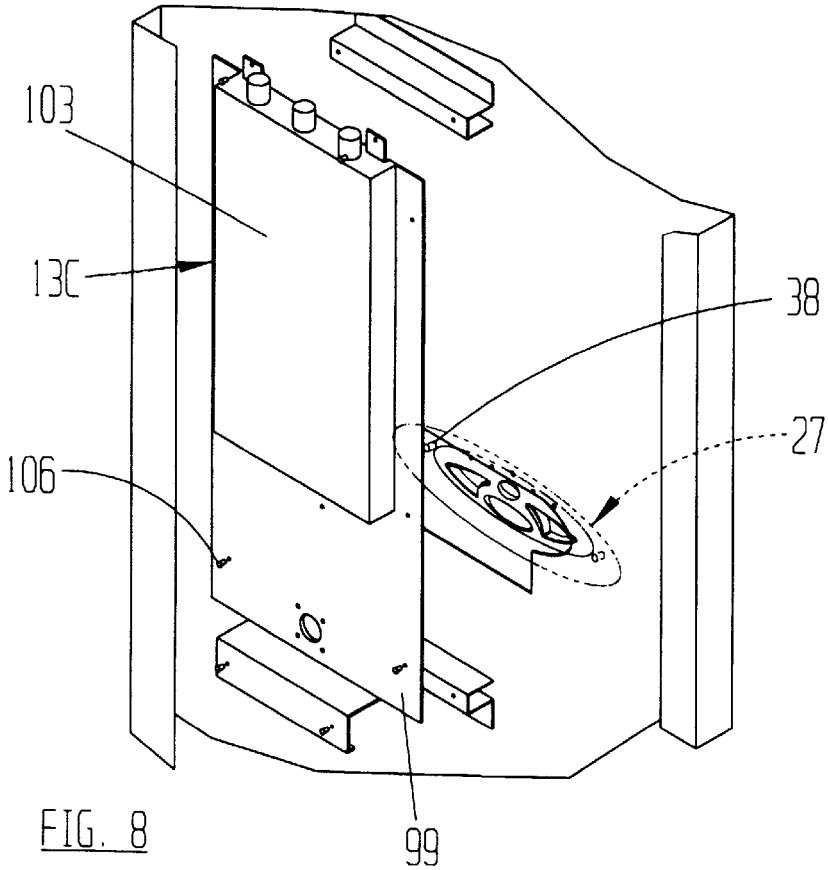
FIG. 8 is a perspective view showing the assembly of a typical control assembly and the operator interface to a mobile carriage.

The operator interface 27 is mounted to a mobile carriage 3, 5, 7 by placing the bezel mounting surface 33 against the carriage end panel 80. There is an opening 82 in each end panel 80 through which the buttons 39, 41, 43, 45 and the bezel lugs 38 pass. The bezel is fastened to the base 99 by conventional fasteners 106 that engage the base and the bezel lugs. Also see FIG. 8. There are holes 102 in the base 99 through which the switches 93 protrude for being contacted by the button bosses 91. A cover 103 fastens to the base 99 to protect the printed circuit board 27. After installation, the operator interface and control assembly are so located relative to the circuit board 97 and base 99 that the button bosses 91 are only in minimal touching contact with the respective switch actuators 95. Further, the button bottom surfaces along the plane 58 are substantially parallel to and spaced a predetermined distance D from the base.

It is an important feature of the invention that at least some of the buttons convey an intuitive meaning to the operators of high density mobile storage. For that purpose, the relatively long and narrow buttons 39 and 43 are used to control the direction of movement of the mobile carriages 3, 5, 7.

Figure 3:
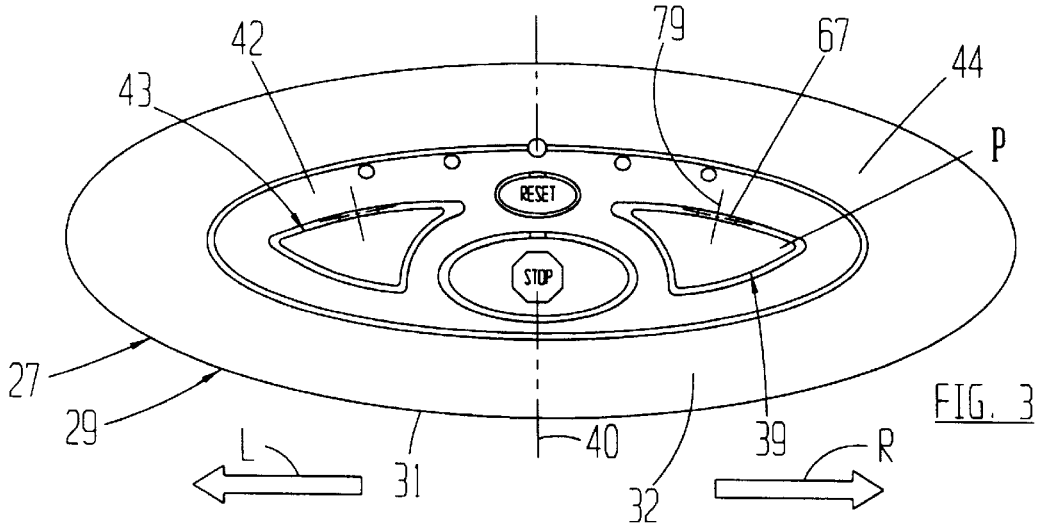
FIG. 3 is a front view of the operator interface of the invention.

Those buttons are located in the right and left sides 42 and 44, respectively, of the bezel 29. The buttons 39 and 43 are shaped to resemble stylized arrowheads that point in the directions R and L (FIG. 1), respectively. Accordingly, an operator intuitively recognizes that button 39 controls a mobile carriage to move in the direction R, and that button 43 controls the mobile carriage to move in the direction L. The buttons 41 and 45 control other aspects of mobile carriage movement. For example, as is illustrated in FIG. 3, the button 41 can be used to reset the control system. The button 45 can be used to stop any or all of the mobile carriages from moving.

In use, a person presses on the desired button 39, 41, 43, or 45 to pivot it in the direction of arrow 77. Doing so actuates the corresponding switch 93. The pivoting of the button is limited by the striking of its bottom surface on the base 99. The limited amount of pivoting is important for the long fatigue life of the living hinges 60, 62, 63, 65. The short pivoting of the buttons is nevertheless adequate to actuate the associated switches. Upon releasing a button, it returns in the direction of arrow 75 to its position as shown in FIG. 5. The combination of the elasticity of the ABS material in the living hinges and springs in the switch actuators 95 assures that the buttons return to their normal state as shown in FIG. 5.

As mentioned previously, the living hinges 60, 62, 63, 65 are designed with substantial torsional rigidity about their respective longitudinal axes 79, 81, 83, 85. Consequently, pressing a button 39, 41, 43, 45 at any point, such as point P on button 39 (FIG. 3), produces proper pivoting of the button in the direction of arrow 77. The buttons are thus self-leveling, even with relatively long and narrow buttons. For example, the buttons can be two times longer than they are wide, as is the case with buttons 39 and 43. In one preferred embodiment, the buttons 39 and 43 are approximately two inches long and have a maximum width of approximately 0.90 inches. The width of the associated living hinges 60 and 63 is approximately 0.30 inches.

Figure 6:
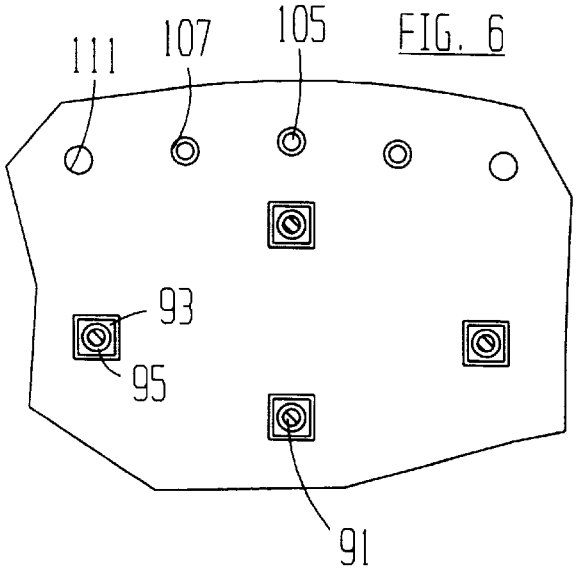
FIG. 6 is a cross-sectional view taken along line 6—6 of FIG. 5.

To further improve the functionality of the operator interface 27 while contributing to its pleasing appearance, indicator lights are incorporated into the control assemblies. As illustrated in FIGS. 5 and 6, there are three indicator lights 105. The lights 105 may be light emitting diodes that are part of the printed circuit board 97. The lights pass through respective openings 107 in the base 99, through the opening 82 in the mobile carriage end panel 80, and also through respective holes 109 in the wall 32 of the bezel 29. There may be other holes in the bezel, if desired. For example, there may be a hole 111 that provides access for a screwdriver or similar tool to a motor speed adjustment control on the printed circuit board.

In summary, the results and advantages of high density mobile storage can now be more fully realized. The operator interface 27 provides both pleasing aesthetics and intuitive functionality to the controls of mobile carriages. This desirable result comes from the combined roles of the living hinges. The hinges enable the respective buttons to be molded from ABS material as one piece with the bezel 29. The hinges have adequate flexibility and fatigue strength to permit repeated pivoting of the buttons about the hinge transverse axes. At the same time, the buttons are self-leveling because of the torsional rigidity of the hinges about their longitudinal axes. Because of the self-leveling feature, the buttons 39 and 43 are able to be shaped as relatively long and narrow stylized arrowheads that are intuitively recognized by an operator as pointing in the directions of mobile carriage travel. The buttons are carefully spaced relative to respective switches 93 and to a base 99. The amount of button pivoting is limited by the base, but only a small amount of pivoting of a button is enough to actuate the associated switch. The switches are an integral part of a control assembly that includes the circuit board 97. That construction is a big improvement over the prior design in which operator actuated switches were separate from and connected to a control module by a cable.

It will also be recognized that in addition to the superior performance of the operator interface 27, its construction is such as to cost little, if any, more than conventional control devices. Also, because it is made as a rugged one-piece part with self-leveling buttons, it will give long service life despite repeated pivoting of the buttons.

Thus, it is apparent that there has been provided, in accordance with the invention, an operator interface for mobile carriages that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. An operator interface comprising:

a. a bezel having a wall with a periphery and an interior that defines at least one opening therethrough of a selected size and a shape that has at least one curved surface;

b. a button inside said at least one bezel opening and having a curved peripheral wall proximate and of the same shape as said at least one bezel opening curved surface, the button curved peripheral wall having a predetermined length dimension with a midpoint and a predetermined width dimension; and c. a living hinge connecting said at least one bezel opening curved surface and the button curved peripheral wall, the living hinge having a width substantially less than the length dimension of the button curved peripheral wall, the living hinge defining a longitudinal axis and a transverse axis and having sufficient elasticity to enable the button to pivot about the living hinge transverse axis relative to the bezel.

2. The operator interface of claim 1 wherein the operator interface is made from an ABS material.

3. The operator interface of claim 1 wherein:

a. the bezel interior defines a plurality of openings therethrough each with at least one curved surface;

b. there is a button in each bezel opening, each button having a curved peripheral wall proximate and of the same shape as the curved surface of the associated bezel opening curved surface, the curved peripheral wall of each button having a predetermined length dimension with a midpoint and a predetermined width dimension; and c. a living hinge connects the curved peripheral wall of each button with the curved surface of the associated bezel opening, each living hinge having a width substantially less than the length dimension of the associated button curved peripheral wall, each living hinge defining a longitudinal axis and a transverse axis and having sufficient elasticity to enable the button to pivot about the associated living hinge transverse axis relative to the bezel.

4. The operator interface of claim 3 wherein:

a. the bezel periphery is generally oval shaped having first and second sides;

b. there are first and second bezel openings with first and second buttons located generally at the first and second sides, respectively, of the bezel; and c. there is at least one button pivotally connected to the bezel between the first and second buttons.

5. The operator interface of claim 1 wherein said at least one bezel opening has a selected shape that is defined exclusively as curved surfaces.

6. The operator interface of claim 1 wherein:

a. the button length dimension is substantially larger than the button width dimension;

b. the living hinge longitudinal axis is located approximately at the midpoint of the button length dimension; and c. the living hinge has sufficient torsional rigidity to minimize rotation of the button about the living hinge longitudinal axis in response to a person pressing on the button at a distance remote from the living hinge longitudinal axis, so that the button is self-leveling.

7. The operator interface of claim 6 wherein the button length dimension is at least twice as large as the width dimension.

8. The operator interface of claim 1 wherein the bezel interior defines a concave center portion.

9. The operator interface of claim 8 wherein the button has a top wall that is located above the bezel concave center portion.

10. An operator interface comprising:

a. a bezel having a wall with a periphery and an interior that defines at least one opening therethrough of a selected size and a shape that has at least one curved surface;

b. a button inside said at least one bezel opening and having a curved peripheral wall proximate and of the same shape as said at least one bezel opening curved surface, the button curved peripheral wall having a predetermined length dimension with a midpoint and a predetermined width dimension; and c. a living hinge connecting said at least one bezel opening curved surface and the button curved peripheral wall, the living hinge having a width substantially less than the length dimension of the button curved peripheral wall, the living hinge defining a longitudinal axis and a transverse axis and having sufficient elasticity to enable the button to pivot about the living hinge transverse axis relative to the bezel, wherein the living hinge comprises opposed surfaces extending between the bezel and the button, and wherein at least one of the living hinge opposed surfaces defines a groove parallel to the living hinge transverse axis.

11. The operator interface of claim 10 wherein both opposed surfaces of the living hinge define a groove parallel to the living hinge transverse axis.

12. A mobile carriage that moves in response to operator commands comprising:

a. a control assembly fastened to the mobile carriage and containing a plurality of switches that selectively control movement of the mobile carriage in first and second direction; and b. an operator interface comprising:

i. a bezel mounted to the mobile carriage and defining a plurality of openings each having at least one curved surface; and ii. a button in each of the bezel openings, each button having a curved peripheral wall proximate and connected by a living hinge to said at least one curved surface of the associated bezel opening, each button being in operative association with a control box switch and being selectively pivotable at the associated living hinge to actuate the associated switch and thereby control the mobile carriage movement.

13. The mobile carriage of claim 12 wherein:

a. the control assembly is fastened to a first side of a mobile carriage panel;

b. the operator interface bezel is mounted to a second side of the mobile carriage panel; and c. the mobile carriage panel has an opening therethrough that enables the operator interface buttons to contact and actuate the associated switches.

14. The mobile carriage of claim 13 wherein the control assembly further contains a base located at a predetermined distance from the operator interface buttons, the base cooperating with the buttons to limit the amount of pivoting of the buttons.

15. The mobile carriage of claim 13 wherein:

a. the control assembly further contains at least one indicator light;

b. the bezel defines at least one hole therethrough, said at least one control assembly indicator light passing through said at least one bezel hole; and c. said at least one indicator light passes through the mobile carriage panel opening to enable said at least one hole in the bezel to receive the said at least one indicator light.

16. The mobile carriage of claim 12 wherein the operator interface is made from ABS material.

17. The mobile carriage of claim 12 wherein:

a. each button has a predetermined length dimension with a midpoint, and a predetermined width dimension;

b. the living hinge associated with each button has a width that is much less than the length dimension of the button and that defines a longitudinal axis and a transverse axis;

c. the longitudinal axis of each living hinge is located approximately at the midpoint of the length dimension of the respective button;

d. the living hinge associated with each button possesses sufficient torsional rigidity about the longitudinal axis thereof to enable the button to pivot about the transverse axis thereof in response to pressing the button at a location remote from the living hinge longitudinal axis, so that the button is self-leveling.

18. The mobile carriage of claim 17 wherein the length dimension of at least one button is approximately twice as large as the width dimension of the said at least one button.

19. The mobile carriage of claim 17 wherein each button comprises a boss that contacts the associated switch, and wherein the boss of each button is located on the longitudinal axis of the living hinge that connects the button to the bezel.

20. The mobile carriage of claim 12 wherein the peripheral walls of the buttons are composed exclusively as curved peripheral walls.

21. The mobile carriage of claim 12 wherein:

a. a first button is formed as a stylized arrowhead that points in the first direction of mobile carriage movement;

b. a second button is formed as a stylized arrowhead that points in the second direction of mobile carriage movement; and c. pressing the first and second buttons actuates associated switches in the control assembly to control the mobile carriage to move in the first and second directions, respectively so that the operator interface conveys an intuitive meaning to an operator commanding the mobile carriage.

22. The mobile carriage of claim 12 wherein each living hinge has opposed surfaces extending between the bezel and the associated button, at least one of the opposed surfaces of each living hinge being formed with a groove that is parallel to the living hinge transverse axis.

23. The mobile carriage of claim 12 wherein:

a. the bezel is generally oval in shape having a left side and a right side;

b. a first button is located in the bezel left side and is designed as a stylized arrowhead that points in the first direction of mobile carriage movement; and c. a second button is located in the bezel right side and is designed as a stylized arrowhead that points in the second direction of mobile carriage movement, so that the operator interface conveys an intuitive meaning to an operator commanding the mobile carriage to move in the first and second directions.

24. The mobile carriage of claim 23 further comprising at least one button located in the bezel generally between the first and second buttons.

25. In combination with a mobile carriage, apparatus for controlling the movements of the mobile carriage in first and second directions comprising:

a. a bezel mounted to the mobile carriage and having first and second openings therein each with at least one curved surface; and b. first and second self-leveling buttons having respective curved peripheral walls proximate the curved surfaces of the first and second bezel openings, respectively, and being pivotally connected at the curved peripheral walls to the respective bezel curved surfaces by respective first and second living hinges, each button having a length dimension that is approximately two times as large as a button width dimension, each living hinge defining a longitudinal axis located at approximately a midpoint of the button length dimension and having a width that is substantially less than the length dimension of the associated button, each living hinge having sufficient torsional rigidity about the longitudinal axis thereof to render the associated button self-leveling when the button is pressed at a point remote from the living hinge longitudinal axis; and c. means for controlling the mobile carriage to move in the first and second directions in response to pressing the first and second buttons, respectively.

26. The combination of claim 25 wherein the first button is shaped to point in the first direction, and the second button is shaped to point in the second direction to thereby convey an intuitive meaning to a person controlling the mobile carriage.

27. The combination of claim 26 wherein:

a. the first and second buttons are located at first and second sides, respectively, of the bezel; and b. there is at least one additional self-leveling button in the bezel between the first and second buttons.

28. A method of commanding a mobile carriage to move in first and second directions comprising the steps of:

a. mounting a bezel having at least two openings therethrough to a first side of a panel of the mobile carriage;

b. fastening a control assembly to a second side of the mobile carriage panel;

c. pivotally connecting at least two buttons to the bezel;

d. pressing a first button and actuating the control assembly to move the mobile carriage in the first direction; and e. pressing a second button and actuating the control assembly to move the mobile carriage in the second direction.

29. The method of claim 28 wherein:

a. the step of mounting a bezel comprises the step of forming each bezel opening with at least one curved surface;

b. the step of pivotally connecting at least two buttons to the bezel comprises the steps of:

i. providing at least two buttons each having a curved peripheral wall proximate the curved surface in the associated bezel opening; and ii. pivotally connecting the curved peripheral wall of each button to the associated bezel curved surface.

30. The method of claim 29 wherein:

a. the step of providing at least two buttons comprises the step of providing each of said at least two buttons with a length dimension that is approximately two times as large as a button width dimension; and b. the step of pivotally connecting the curved peripheral wall of each button comprises the step of providing a living hinge having a width much less than the button length dimension between the curved peripheral wall of each button and the associated bezel curved surface.

31. The method of claim 30 wherein the step of providing a living hinge comprises the steps of:

a. providing a living hinge that defines a transverse axis and a longitudinal axis and that has a width much less than the button length dimension;

b. locating the living hinge longitudinal axis at approximately a midpoint of the length dimension of the associated button; and c. providing the living hinge with sufficient torsional rigidity about the longitudinal axis to make the button self-leveling.

32. The method of claim 28 wherein the step of pivotally connecting at least two buttons comprises the step of providing first and second buttons having respective curved peripheral walls shaped to point in the first and second directions, respectively, and thereby conveying an intuitive meaning to an operator commanding the mobile carriage.

33. The method of claim 32 wherein:

a. the step of mounting a bezel comprises the step of providing a bezel having right and left sides; and b. the step of providing at least two buttons comprises the step of locating a first button in the bezel right side, and locating a second button in the bezel left side.

34. The method of claim 33 comprising the further step of pivotally connecting at least one third button to the bezel between the first and second buttons.

35. The method of claim 28 wherein:

a. the step of fastening a control assembly comprises the steps of providing a switch in operative association with each button, and passing the switches through the mobile carriage panel;

b. the step of pressing a first button comprises the step of actuating a first switch to control the mobile carriage to move in the first direction; and c. the step of pressing a second button comprises the step of actuating a second switch to control the mobile carriage to move in the second direction.

36. The method of claim 28 wherein:

a. the step of fastening a control assembly comprises the step of providing a base at a predetermined distance from the buttons connected to the bezel;

b. the step of pressing the first button comprises the step of contacting the first button with the base and thereby limiting the amount of pivoting of the first button; and c. the step of pressing the second button comprises the step of contacting the second button with the base and thereby limiting the amount of pivoting of the second button.

37. The method of claim 28 wherein the step of fastening a control assembly comprises the steps of:

a. providing at least one light emitting diode on the control assembly; and b. passing the light emitting diode through the mobile carriage panel and receiving the light emitting diode in a hole in the bezel, so that an operator commanding the mobile carriage can view the light emitting diode.

* * * * *